United States Patent [19]

Kleinberg

[11] Patent Number: 4,704,147

[45] Date of Patent: Nov. 3, 1987

[54] DUAL AIR PRESSURE CYCLE TO PRODUCE LOW PURITY OXYGEN

[75] Inventor: William T. Kleinberg, Breinigsville, Pa.

[73] Assignee: Air Products and Chemicals, Inc., Allentown, Pa.

[21] Appl. No.: 898,281

[22] Filed: Aug. 20, 1986

[51] Int. Cl.[4] ..... F25J 3/02

[52] U.S. Cl. ..... 62/24; 62/32; 62/43

[58] Field of Search ..... 62/11, 23, 24, 29, 32, 62/42, 43

[56] References Cited

U.S. PATENT DOCUMENTS

| | | | |
|---|---|---|---|
| 3,210,951 | 10/1965 | Gaumer | 62/29 |
| 3,277,655 | 10/1966 | Geist et al. | 62/29 |
| 3,327,489 | 6/1967 | Gaumer | 62/29 |
| 3,754,406 | 8/1973 | Allam | 62/41 |
| 3,763,658 | 10/1973 | Gaumer, Jr. et al. | 62/11 |
| 4,433,989 | 2/1984 | Erickson | 62/42 |
| 4,464,191 | 8/1984 | Erickson | 62/42 |
| 4,615,716 | 10/1986 | Cormier et al. | 62/24 |
| 4,617,036 | 10/1986 | Suchdeo et al. | 62/42 |
| 4,617,037 | 10/1986 | Okada et al. | 62/11 |

*Primary Examiner*—Ronald C. Capossela

*Attorney, Agent, or Firm*—Willard Jones, II; James C. Simmons; E. Eugene Innis

[57] ABSTRACT

In a process for the production of an oxygen-enriched air product, feed air is fed to the main heat exchangers at two pressures. The high pressure feed air from the main exchanger is partially condensed to vaporize the oxygen-enriched air product. This partially condensed feed air is separated with the vapor phase being warmed and expanded to supply refrigeration and subsequently being fed to the low pressure fractionation section, and the liquid phase being used to reflux both the high pressure and low pressure fractionation sections of a double distillation column. The low pressure feed air from the main heat exchangers is fed to the high pressure fractionation section. The high pressure fractionation section condenser is used to provide reboiler duty to the low pressure fractionation section.

5 Claims, 1 Drawing Figure

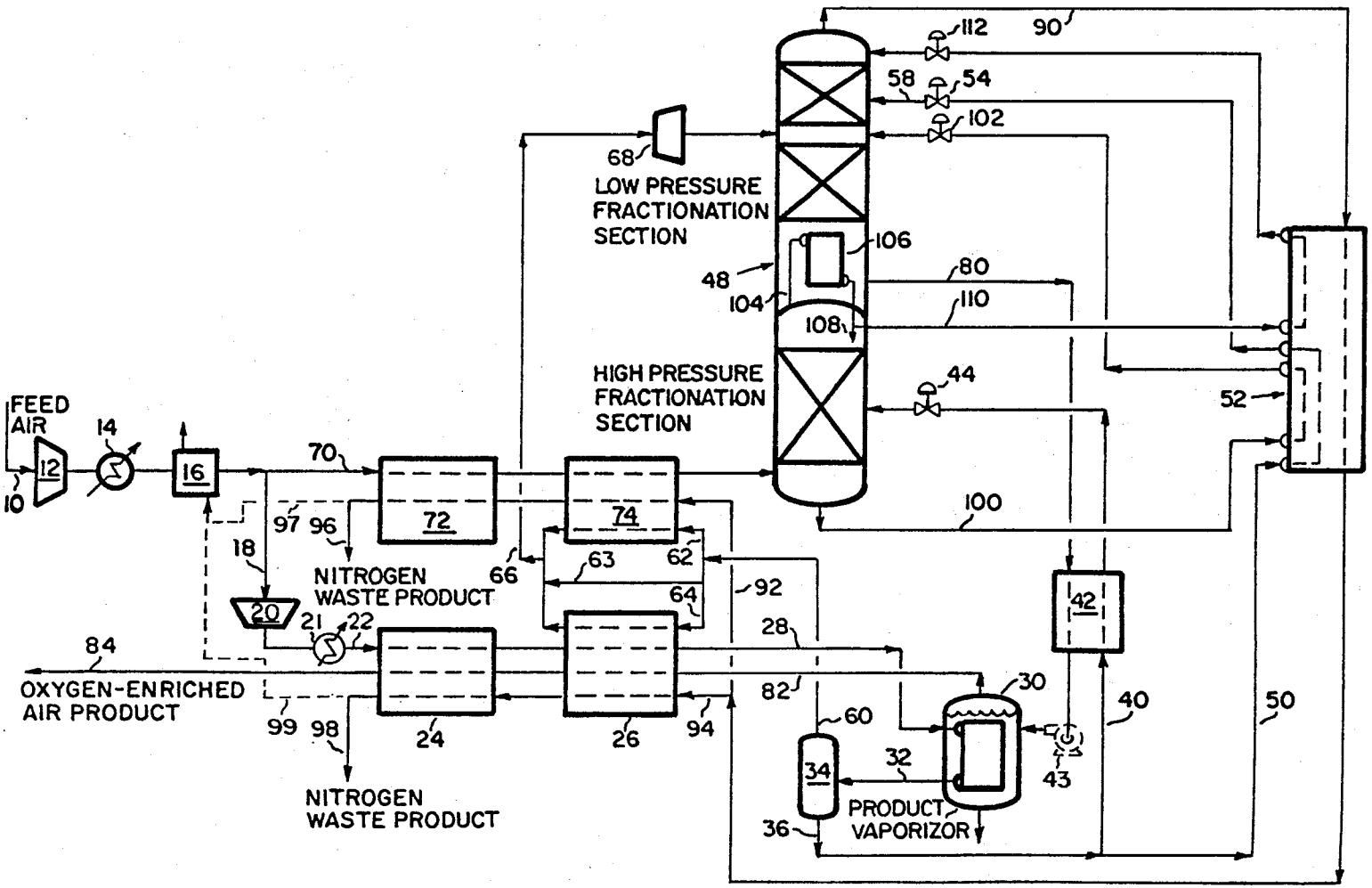
LOW PRESSURE FRACTIONATION SECTION
HIGH PRESSURE FRACTIONATION SECTION
PRODUCT VAPORIZOR
NITROGEN WASTE PRODUCT
NITROGEN WASTE PRODUCT
OXYGEN-ENRICHED AIR PRODUCT
FEED AIR

DUAL AIR PRESSURE CYCLE TO PRODUCE LOW PURITY OXYGEN

TECHNICAL FIELD

The present invention relates to the separation of air into its constituent parts by distillation of the feed air in a double distillation column.

BACKGROUND OF THE INVENTION

Several processes have been used commercially or have been proposed to produce an oxygen-enriched air product by fractionation of air into its constituent components.

In U.S. Pat. No. 3,210,951, a fractionation cycle employing first and second fractionating zones operating under different pressures and including two reboiler/condensers is disclosed. Both of the reboiler/condensers are interconnected with the stages of fractionation in such a manner as to effect the required reboil and reflux production with minimum pressure differential between the stages of rectification and also decrease the irreversibility of the overall fractionation process thereby obtaining the desired separation with the high pressure stage operating under substantially reduced pressure.

In U.S. Pat. No. 3,277,655, an improvement to the fractionation process taught in U.S. Pat. No. 3,210,951 is disclosed. In this process, the heat exchange occurring in one of the two reboiler/condensers between the bottoms liquid from the low pressure column and the gaseous material from the high pressure column results in complete liquefaction of the gaseous material and effects vaporization of a quantity of the bottoms liquid from the low pressure column thereby satisfying the reboiler requirements of the low pressure column. Additionally, when the liquefied gaseous material from the high pressure column is introduced into the low pressure column it improves the reflux ratio in the upper portion of the low pressure column which increases the separation efficiency and makes it possible to lower the pressure of the gaseous mixture entering the cycle.

In U.S. Pat. No. 3,327,489, another improvement to U.S. Pat. No. 3,210,951 to lower the pressure in the high pressure fractionator is disclosed. In the process, the pressure reduction is obtained along with the associated power reduction by establishing a heat exchange between gaseous material, which may comprise the feed mixture, and a liquid component collecting in the bottom of the low pressure fractionator, with the liquid component being under different pressure.

In U.S. Pat. No. 3,754,406, a process is disclosed for the production of low purity oxygen, in which a low pressure stream of incoming air is cooled against outgoing gas streams and fed into a high pressure distillation column. A high pressure stream of incoming air is cooled against outgoing gas stream, partially condensed against boiling oxygen product in a product vaporizer, and separated into gas and liquid streams. The liquid stream being subcooled and expanded into a low pressure fractionating column. The gas stream is reheated and expanded to provide process refrigeration and is introduced into the low pressure fractionating column. Crude liquid oxygen from the bottom of the high pressure column is cooled and introduced into the low pressure column after being used to liquefy some of the nitrogen from the high pressure column in an external reboiler condenser. Liquid oxygen product from the low pressure column is pumped to a higher pressure before being passed to the subcooler and the product vaporizer. The remainder of the high pressure nitrogen is liquefied in a second external reboiler/condenser and is used as reflux for the two columns. A waste nitrogen stream is removed from the low pressure column.

BRIEF SUMMARY OF THE INVENTION

A process for the production of oxygen-enriched air by the fractionation of air in a double distillation column having a high pressure and low pressure fractionation section is disclosed. In the process a feed air stream is compressed and split into a first feed air stream and a second feed air stream. Preferably, this compressed feed air stream has had any impurities which would freeze out at process conditions, e.g. water and carbon dioxide, removed from the stream in an adsorber prior to being split. The first air stream is compressed, cooled against warming process streams and partially condensed, by heat exchange with the vaporizing oxygen-enriched air product, prior to being separated into a liquid feed air stream and a vapor feed air stream. The liquid feed air stream is then split into a first liquid feed air substream and a second liquid feed air substream. The first liquid feed air substream is subcooled, reduced in pressure and introduced into intermediate location in the high pressure fractionation section of the double distillation column. The second liquid substream is subcooled, reduced in pressure and introduced into an upper location in the low pressure fractionation section of said double distillation column. The vapor feed air stream is warmed, expanded and introduced into an intermediate location in the low pressure fractionation section of said double distillation column. The second feed air stream is cooled and introduced into the bottom of the high pressure fractionation section of said double distillation column.

A nitrogen waste product is removed as an overhead from the low pressure fractionation section, and warmed against other process streams to recover refrigeration. A liquid oxygen-enriched air stream is removed from the low pressure fractionation section, and warmed and vaporized against other process streams to recover refrigeration.

An overhead stream from the high pressure fractionation section is condensed and at least a portion of the condensed overhead stream is returned to the high pressure fractionation section as reflux; the remaining portion of the condensed overhead is subcooled and reduced in pressure, prior to being introduced to the low pressure fractionation section as reflux. A bottoms liquid stream from the high pressure fractionation section is removed, cooled and reduced in pressure, prior to being introduced to the low pressure fractionation section.

BRIEF DESCRIPTION OF THE DRAWING

The single FIGURE of the drawing is a schematic diagram of the process of the present invention.

DETAILED DESCRIPTION OF THE INVENTION

Referring to the single FIGURE of the drawing, air enters the plant, via line 10, is compressed in compressor 12, aftercooled in exchanger 14, has had any impurities which would freeze out in the process, e.g. water and carbon dioxide, removed in adsorber 16 and split into two streams, a first feed air stream (line 18) and a second feed air stream (line 70). Alternative means for removing impurities, e.g. a reversing heat exchanger, can be used in the present invention as a replacement for the absorber. The first feed air stream in line 18 is further compressed in compressor 20, aftercooled in heat exchanger 21 and fed to heat exchangers 24 and 26, via line 22. This cooled pressurized first air feed stream, now in line 28 is fed to oxygen product vaporizer 30 where it is partially condensed. This partially condensed feed air stream is removed from vaporizer 30, via line 32, and separated in separator 34 into a liquid feed air stream and a vapor feed air stream. The liquid feed air stream is removed from separator 34, via line 36, and split into two substreams. The first subsream, in line 40, is subcooled in exchanger 42 against the liquid oxygen product stream, reduced in pressure in J-T valve 44 and introduced into an intermediate location in the high pressure fractionation section of double distillation column 48 as reflux. The second substream, in line 50, is heat exchanged in exchanger 52, reduced in pressure in J-T valve 54 and introduced into an upper location in the low pressure fractionation section of double distillation column 48, via line 58, as reflux.

A vapor stream is removed from separator 34, via line 60, and split into three substreams. A first substream, in line 62, is warmed in exchanger 74, and a second substream, in line 64, is warmed in exchanger 26. A third substream, in line 63, is unchanged. These two warmed substreams and the unchanged third substream are then reunited, in line 66, expanded in expander 68 and fed to an intermediate location in the low pressure fractionation section of double distillation column 48.

The second feed air stream in line 70 is cooled in heat exchangers 72 and 74 and introduced into the bottom of the high pressure fractionation section of double distillation column 48.

A liquid bottom stream is removed from the high pressure fractionation section of double distillation column 48, via line 100, cooled in exchanger 52, and reduced in pressure in J-T valve 102, prior to being fed to an intermediate location of the low pressure fractionation section of double distillation column 48. An overhead stream from the high pressure fractionation section of double distillation column 48 is removed, via line 104, condensed in reboiler/condenser 106 thereby providing reboiler duty to the low pressure fractionation section of column 48, and split into two substreams. The first substream, in line 108, is returned to the high pressure fractionation section of column 48 as reflux; the second substream, in line 110, is cooled in exchanger 52 and expanded in J-T valve 112, prior to being introduced as reflux to the low pressure fractionation section of column 48.

A liquid oxygen-enriched product stream is removed from the bottom of the low pressure fractionation section of double distillation column 48, via line 80. This liquid oxygen-enriched stream, in line 80, is warmed in heat exchanger 42 and vaporized in vaporizer 30. Optionally, the liquid oxygen-enriched product stream can be pumped to a higher pressure with pump 43 prior to vaporization, thereby increasing the pressure of the gaseous product. The gaseous oxygen-enriched stream is removed from vaporizer 30, via line 82, warmed in heat exchangers 26 and 24, and removed from the process as an oxygen enriched gaseous product, via line 84.

A nitrogen waste product stream is removed from the top of the low pressure fractionation section of double distillation column 48, via line 90. This nitrogen waste product stream is then warmed in heat exchanger 52 and split into two substreams, lines 92 and 94 respectively. The first nitrogen substream, in line 92, is warmed in heat exchangers 74 and 72 and removed from the process, via line 96. The second nitrogen substream, in line 94, is warmed in heat exchangers 26 and 24 and removed from the process, via line 98. These nitrogen waste product substreams can be utilized for product or can be vented to the atmosphere. Optionally, a portion of the nitrogen waste product stream can be used to regenerate adsorber 16, as representively shown by dashed line 97 and 99.

The optimum product purity for the present invention, which produces an oxygen-enriched air, is approximately 70% by volume. As an example, for the production of this 70% by volume oxygen-enriched product in the present invention, ambient air is compressed in compressor 12 to about 50 psia. A first portion, in line 18, which is approximately 57.5 mol % of the feed air, is further compressed in compressor 20 to 64 psia, cooled in to −288° F. in exchangers 24 and 26, and partially condensed in vaporizer 30. This partially condensed stream, in line 32, is separated into a liquid and vapor stream. The liquid stream, in line 36, which is approximately 57.9 mol % of partially condensed stream, in line 32, is split into two substreams. The first substream, in line 40, which is approximately 57.1 mol % of liquid stream in line 36, is subcooled to −296° F. in exchanger 42, reduced in pressure to 47 psi in J-T valve 44 and fed to the high pressure fractionation section of column 48. The second substream, in line 50, which is the remaining 42.9 mol % of the liquid stream in line 36, is cooled to −301° F. in exchanger 52, reduced in pressure to 19.5 psia in J-T valve 54 and fed to the low pressure fractionation section of column 48. The vapor stream in line 60, which is approximately 42.1 mol % of the partially condensed stream in line 32, is split into three substreams; two of the substreams are warmed in exchangers 26 and 74 with the third substream passing unchanged. The three substreams are reunited (the temperature of the united stream is −256° F.), expanded to 20 psia in expander 68 and fed to the low pressure fractionation section of distillation column 48. The low pressure feed air in line 70 is cooled to −288° F. in exchangers 72 and 74 and fed to the high pressure fractionation section of column 48.

A liquid oxygen-enriched product at −302.6° F. is removed from high pressure column 48, via line 80, warmed to −299° F. in exchanger 42, vaporized in vaporizer 30, further warmed in exchangers 26 and 24 and removed from the process in line 84. This oxygen-enriched air product has a purity of 70% by volume oxygen, is removed at a pressure of 21.5 psia and a temperature of 40° F., and accounts for approximately 28.4 mol % of the feed air. A nitrogen waste product stream is removed from column 48, via line 90, warmed in a series of exchangers and removed from the process, via lines 96 and 98. The nitrogen waste product in lines 96 and 98 combined account for approximately 71.6 mol % of the feed air. The nitrogen waste product is removed at a pressure of 15 psia and an average temperature of 45.5° F.

On the basis of 150 MSCFH contained oxygen of a 70% by volume oxygen, oxygen-enriched air product, the energy requirements for the present invention is approximately 1650 hp, this represents a 4.5% reduction in the energy requirements for the process disclosed in U.S. Pat. No. 3,754,406. A 4.5% reduction in the energy requirements for an air separation process is considered to be a significant reduction.

The present invention has been described with reference to a specific embodiment thereof. This embodiment should not be considered a limitation on the scope of the present invention, such limitations on the scope of the present invention being ascertained by the following claims.

I claim:

1. A process for the production of oxygen-enriched air by the fractionation of air in a double distillation column having a high pressure and low pressure fractionation section, which comprises the steps of:

(a) compressing a feed air stream and splitting said feed air stream into a first feed air stream and a second feed air stream;

(b) compressing the second feed air stream, prior to cooling said second stream against warming process streams;

(c) partially condensing said second feed air stream and separating into a liquid feed air stream and a vapor feed air stream;

(d) splitting the liquid feed air stream into a first liquid feed air substream and a second liquid feed air substream;

(e) cooling the first liquid feed air substream and introducing said first liquid substream into the high pressure fractionation section of said double distillation column;

(f) cooling, expanding and introducing said second liquid feed air substream into the low pressure fractionation section of said double distillation column;

(g) warming, expanding and introducing said vapor feed air stream into the low pressure fractionation section of said double distillation column;

(h) cooling the second feed air stream and introducing said cooled second feed air stream into the high pressure fractionation section of said double distillation column;

(i) removing a liquid oxygen-enriched air stream from the low pressure fractionation section, and warming and vaporizing said liquid oxygen-enriched air stream against other process streams to recover refrigeration;

(j) condensing an overhead stream from the high pressure fractionation section, returning at least a portion of the condensed overhead stream to the high pressure fractionation section as reflux, and cooling and expanding the remaining portion of the condensed overhead, prior to introducing said remaining overhead to the low pressure fractionation section as reflux; and (k) removing a bottoms liquid stream from the high pressure fractionation section, cooling and expanding said bottoms stream prior to introducing said bottoms stream to the low pressure fractionation section.

2. The process of claim 1 which further comprises pumping said liquid oxygen-enriched air stream to a higher pressure prior to vaporization.

3. The process of claim 1 which further comprises removing in an adsorber any impurities which would freeze in the process from the compressed feed air stream.

4. The process of claim 3 wherein a nitrogen waste stream is removed from the low pressure distillation column which further comprises utilizing at least a portion of said nitrogen waste stream to regenerate the adsorber.

5. The process of claim 1 which further comprises removing in a reversing heat exchanger any impurities which would freeze in the process from the compressed feed air stream.

* * * * *